US009669424B2

(12) United States Patent
Winkler et al.

(10) Patent No.: US 9,669,424 B2
(45) Date of Patent: Jun. 6, 2017

(54) THREE DIMENSIONAL DECORATION METHOD

(71) Applicant: The Swatch Group Research and Development Ltd, Marin (CH)

(72) Inventors: Yves Winkler, Schmitten (CH); Stewes Bourban, Cudrefin (CH); Pascal Grossenbacher, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 84 days.

(21) Appl. No.: 14/667,072

(22) Filed: Mar. 24, 2015

(65) Prior Publication Data

US 2015/0352593 A1 Dec. 10, 2015

Related U.S. Application Data

(62) Division of application No. 13/131,910, filed as application No. PCT/EP2009/065910 on Nov. 26, 2009, now Pat. No. 8,999,217.

(30) Foreign Application Priority Data

Nov. 28, 2008 (EP) ..... 08020713

(51) Int. Cl.

| | |
|---|---|
| ***B05D 1/32*** | (2006.01) |
| ***G04B 37/22*** | (2006.01) |
| ***B22D 19/00*** | (2006.01) |
| ***B21J 1/00*** | (2006.01) |
| ***G04B 19/10*** | (2006.01) |
| ***G04B 19/18*** | (2006.01) |
| ***G04D 3/00*** | (2006.01) |

(52) U.S. Cl.
CPC ..... *B05D 1/32* (2013.01); *B21J 1/006* (2013.01); *B22D 19/00* (2013.01); *G04B 19/10* (2013.01); *G04B 19/18* (2013.01); *G04B 37/22* (2013.01); *G04D 3/0048* (2013.01)

(58) Field of Classification Search
CPC B29C 2033/0094; B22D 19/00; B22D 19/04; B05D 1/32; G04B 19/10; G04B 19/18
USPC ..... 264/259, 264
See application file for complete search history.

(56) References Cited

U.S. PATENT DOCUMENTS

| | | | |
|---|---|---|---|
| 7,134,784 | B1 | 11/2006 | Marin |
| 2002/0003013 | A1 | 1/2002 | Hays |

FOREIGN PATENT DOCUMENTS

| | | | |
|---|---|---|---|
| CH | 314 708 | A | 6/1956 |
| CH | 338 149 | A | 4/1959 |
| CH | 395 870 | A | 7/1964 |
| EP | 0 453 382 | A1 | 10/1991 |
| FR | 1 280 803 | A | 12/1960 |

(Continued)

*Primary Examiner* — Christina Johnson
*Assistant Examiner* — Xue Liu
(74) *Attorney, Agent, or Firm* — Sughrue Mion, PLLC

(57) ABSTRACT

A method of decorating an element. This method includes the following steps: taking the element (1, 11, 21, 31), the element including anchoring for improving the securing of the decoration (5) to the element; making a mask (4) of the desired thickness of the decorations (5), and having at least one opening (4'); placing the at least one opening in the mask (4) against the place to be decorated so as to form at least one mould (4', 6, 6', 6",100); filling the at least one mould with an at least partially amorphous material via hot forming; and removing the mask (4).

7 Claims, 4 Drawing Sheets

(56) References Cited

FOREIGN PATENT DOCUMENTS

| | | | |
|---|---|---|---|
| GB | 2 027 636 | A | 2/1980 |
| JP | 61-037998 | A | 2/1986 |
| JP | 404124246 | A | 4/1992 |

THREE DIMENSIONAL DECORATION METHOD

CROSS REFERENCE TO RELATED APPLICATION

This application is a divisional of U.S. application Ser. No. 13/131,910, filed May 23, 2011 which is a National Stage Application of International Application No. PCT/EP2009/065910 filed Nov. 26, 2009, claiming priority based on European Patent Application No. 08020713.7, filed Nov. 28, 2008. The entire disclosures of the prior applications are considered part of the disclosure of the accompanying divisional application, and are hereby incorporated by reference.

The present invention concerns a method of decorating an element.

BACKGROUND OF THE INVENTION

Methods of making decorations as raised portions on a base or substrate such as a watch dial or a bezel are known from the prior art. These methods consist in manufacturing the decorations and the base separately and then securing them to each other.

Thus, in order to fix the decorations to the base, it is known to use bonding, soldering or setting techniques.

However, these methods are not without drawbacks. Indeed, first they require a high level of precision. This precision is due to the fact that the decorations are often of very small size, i.e. of the order of the millimeter. This then requires adapting the tools used to manufacture the decorations according to the size of the decorations, in the knowledge that the smaller the size of the decorations, the more expensive the tools.

Moreover, another drawback of these methods is that the assembling process, which must be precise, generally requires human intervention, involving not simply an increase in costs but also a greater risk of assembling errors.

There is also known from FR Patent No 1,280,803 a method of making decorations on a dial. This method consists in placing a mould with pattern cavities on the dial and filling them via galvanoplasty. The mould is then removed leaving only the dial with the decorations.

One drawback of this system is that the indices are not well secured. Indeed, they are made on the surface of the dial without any means of ensuring the decorations are properly secured to said dial.

Moreover, by definition, galvanoplasty does not allow the deposition of elements over a large thickness, and this technique is therefore limited.

SUMMARY OF THE INVENTION

It is an object of the present invention to provide a three-dimensional decoration method which overcomes the aforementioned drawbacks of the prior art by proposing a less expensive and simpler method.

The invention therefore concerns an aforementioned three-dimensional decoration method, which is characterized in that it includes the following steps:

a) taking the element, said element including anchoring means for improving the securing of the decoration to said element;

b) making a mask of the desired thickness of the decorations, and having at least one opening;

c) placing said at least one opening in the mask against the place to be decorated, so as to form at least one mould;

d) filling said at least one mould by hot shaping with an at least partially amorphous material;

e) removing the mask.

One advantage of this method is its simplicity. Indeed, the base or substrate and the decorations were previously made separately before being assembled to each other. With the method according to the present invention, the decorations are made at the same time that they are assembled to said base. Advantageously according to the invention, all of the decoration can also be made at the same time.

Another advantage is that the use of a mask means that a great diversity of decoration shapes can be made, but also that the height of the decorations can be very simply adjusted. Indeed, the shape of the decorations is directly linked to the shapes of the openings in the mask.

Moreover, the thickness of the mask directly determines the height of the corresponding decorations. It thus becomes easy to modify the shape of the decorations simply by replacing the mask used.

Another advantage is that the method fixes the decorations securely to the base.

Another advantage is the use of amorphous metal, which allows the decorations to be very precise. Indeed, when the amorphous metal is heated to reach a temperature comprised between the vitreous transition temperature Tg and crystallisation temperature Tx of said material, the viscosity thereof is greatly decreased without losing the amorphous structure. The amorphous material thus becomes easier to shape since it can then perfectly match all of the details of the mould into which it is pressed.

Advantageous embodiments of the decoration method are described herein.

One advantage of these embodiments is that they allow the decorations to be fixed more securely to the base.

The invention also concerns an aforementioned three-dimensional decoration method which is characterized in that it includes the following steps:

a) taking the element, said element including anchoring means for improving the securing of the decoration to said element, said anchoring means including at least one part mounted in a through cavity in said element located at the place that has to be decorated;

b) making a mask of the desired thickness of the decorations, and having at least one opening;

c) placing said at least one mask opening against the place to be decorated so as to form at least one mould;

d) filling said at least one mould with a material via galvanoplasty;

e) removing the mask.

The invention further concerns an aforementioned three-dimensional decoration method, which is characterized in that it includes the following steps:

a) taking the element, said element including anchoring means for improving the securing of the decoration to said element;

b) making a mask of the desired thickness of the decorations, and having at least one opening;

c) placing said at least one mask opening against the place to be decorated so as to form at least one mould;

d) filling said at least one mould by injecting it with material so that the element is at least partially amorphous;

e) removing the mask.

BRIEF DESCRIPTION OF THE FIGURES

The objects, advantages and features of the method according to the present invention will appear more clearly in the following detailed description of embodiments of the invention, given solely by way of non-limiting example and illustrated by the annexed drawings, in which.

DETAILED DESCRIPTION

This description concerns a three-dimensional decoration method for a watch dial. However, this example will be taken by way of non-limiting example and it is evident that this method may be applied to any sort of element such as a watch bezel or any other element able to receive three-dimensional decorations.

Figure 1A:
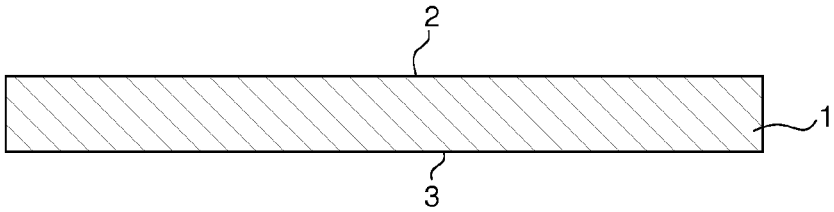
FIGS. 1*a* to 1*e* show schematically the various steps of the method according to a first embodiment of the present invention.
Figure 1B:
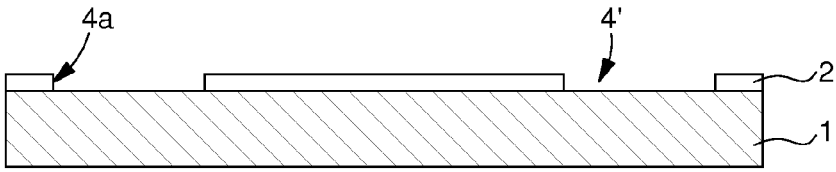
Figure 1C:
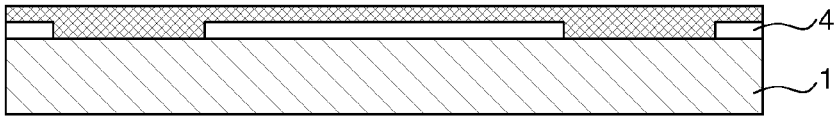
Figure 1D:
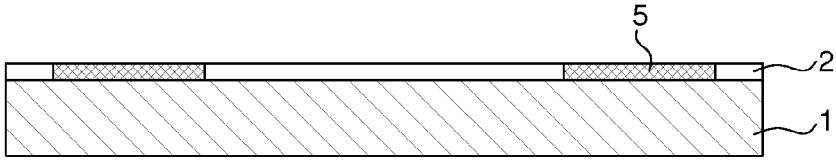
Figure 1E:
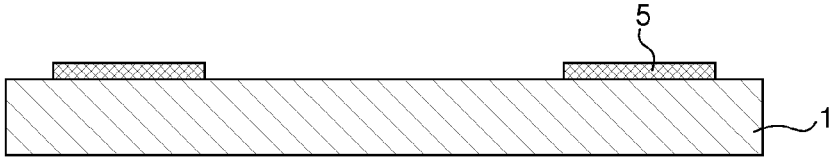

FIGS. 1*a* to 1*e* show a first embodiment of the present invention.

In a first step a), a dial 1 is made. This dial 1 has a top face 2 and a bottom face 3. Dial 1 may be made in a metal or metal alloy and/or another commonly used material, such as ceramic or enamel. Dial 1 is made by known methods, such as machining, moulding or other techniques.

The top surface 2 of dial 1 may have any shape, i.e. have a flat or curved, smooth or sculpted profile, such as notched, for example by engine-turning or circular graining.

In a second step b), a mask 4 is made and then placed on top surface 2 of dial 1. This mask 4 has openings 4'. These openings 4' define the shape and thickness of the future decorations 5. Mask 4 may also have a non-constant thickness thus allowing decorations 5 of different thicknesses to be made.

Thus, when mask 4 is placed on dial 1, this is carried out such that openings 4' in mask 4 are located above the areas of dial 1 that have to be decorated. It is thus clear that openings 4' form a mould the bottom of which is closed by dial 1.

Thus the shapes and dimensions of mask 4 and dial 1 may or may not be identical.

In a third step, called step c), the mould thereby formed by dial 1 and mask 4 is filled with the material forming decorations 5.

In a first variant, opening 4' is filled by hot forming. This technique uses adaptation of the viscosity of materials so as to fill spaces completely and thus allow homogenous and precise manufacture of decorations 5.

It is therefore necessary to have a material, such as, for example, a precious or non-precious metal or metal alloy, which may, for example, be made amorphous. To achieve this, the material is made liquid at a higher temperature than its melting temperature and then cooled quickly. This thus prevents the atoms from being structured.

During production of this amorphous material, the latter is preferably shaped as a preform. This preform has a similar appearance to the part to be made. In this example, the decorations 5 to be made on dial 1 may be hour symbols arranged in a ring around dial 1. Thus, the preform made of amorphous material preferably has an annular shape. The width of the preform is at least equal to the width of the hour symbols.

Subsequently, dial 1 is placed in a hot press and then covered by mask 4, such that openings 4' are above the places that are to receive decorations 5. The preform made of amorphous material is placed above mask 4. The whole assembly is then heated to a temperature comprised between the vitreous transition temperature Tg and crystallisation temperature Tx of said material. Within this temperature interval, the viscosity of the amorphous material is greatly decreased without losing the amorphous structure. The amorphous material then becomes easier to shape since it can then be perfectly moulded to all the details of the mould into which it is pressed.

Once this temperature interval has been reached, pressure is exerted in order to fill said moulds and then the material is cooled sufficiently quickly to preserve the amorphous state.

Surface finishes may be carried out before mask 4 is removed. Indeed, the finish of the vertical walls of decorations 5 may be carried out by sculpting the walls 4*a* of mask 4 straight away. The finishes of the horizontal surfaces of decorations 5 may be carried out after any surplus material has been removed, thus providing a contrast in finish between the various surfaces of decorations 5.

In a second variant, the mould formed by dial 1 and mask 4 is filled by galvanoplasty. This technique is used to make metal decorations 5. To achieve this, a bath including suitable metal ion salts is used. As with the hot forming method, mask 4 is placed on dial 1 so as to form a mould whose bottom is made electrically conductive. The conductive parts of dial 1 are then connected to an electrode and the whole assembly is then dipped into said bath. Using a counter-electrode, an electrical current is then sent so as to achieve galvanoplastic electrolysis. This galvanoplasty produces a migration of the metal ions of the bath to the conductive parts of dial 1 so as to form decorations 5. Of course, those skilled in the art of galvanoplasty will adapt the parameters depending upon the material and thickness of decorations 5, without requiring any explanation thereof in the present invention.

In a third variant, decorations 5 are made by metal injection. The dial 1-mask 4 unit is placed in an injection moulding machine capable of filling the moulds with liquid metal in order to create said decorations 5. Preferably, the metal used will be brought to a temperature that is at least higher than the vitreous transition temperature Tg and will be cooled so as to give the metal an amorphous structure. The amorphous structure then allows less solidifying shrinkage compared to a metal with a crystalline structure.

A fourth step d) may be carried out in order to remove any surplus material deposited during step c). This surplus deposited material is removed by lapping or any other possible means, such as, for example, by a chemical bath.

Finally, in a step e), mask 4 is removed from dial 1 taking care not to damage the decorations. A dial 1 is thus obtained whose top surface 2 includes decorations 5.

Figure 2A:
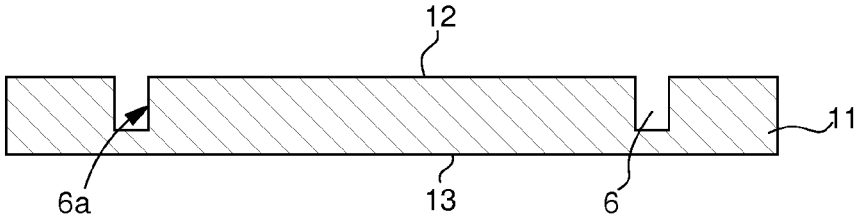
FIGS. 2*a* to 2*e* show schematically the various steps of the method according to a second embodiment of the present invention.
Figure 2B:
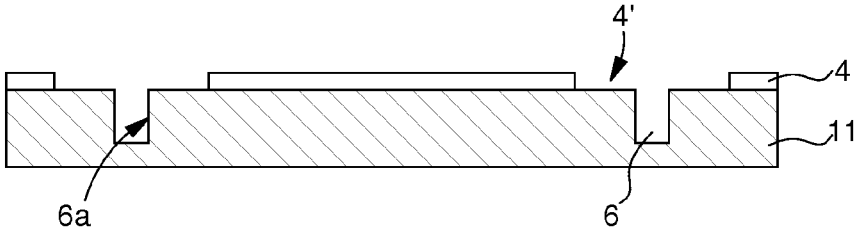
Figure 2C:
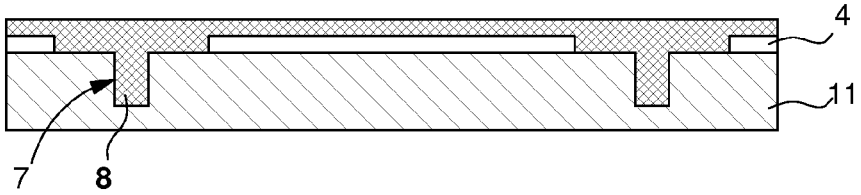
Figure 2D:
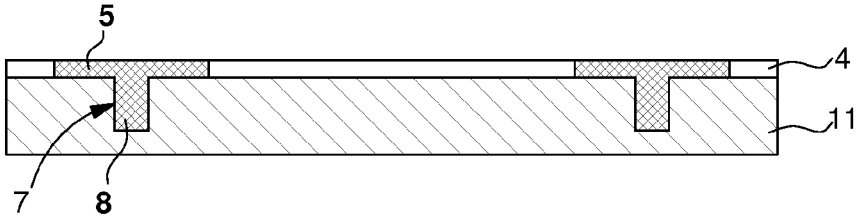
Figure 2E:
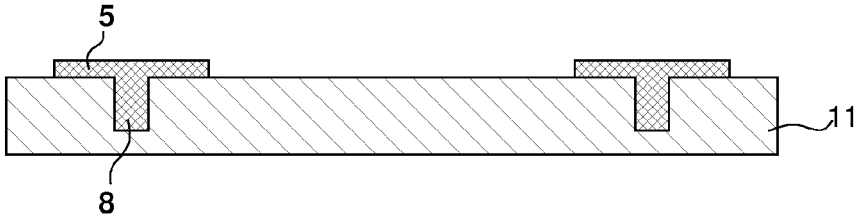

In a second embodiment shown in FIGS. 2*a* to 2*e*, step a) consists in making dial 11 which will be decorated. However, this embodiment differs in that cavities 6 are present on the top surface 12 of dial 11. These cavities 6 are made at the places where decorations 5 are to be made. Preferably, cavities 6 have a smaller section than that of decorations 5. They are intended to form anchoring means 7 for better securing decorations 5.

The securing of anchoring means 7 may be more or less important depending upon the inclination of walls 6*a* of cavities 6 relative to a vertical plane. Thus, the walls of cavities 6 may belong to said vertical plane or be inclined relative to said plane. Anchoring means 7 in cavity 6 will be of better quality if the inclination of walls 6*a* of cavity 6 produces a section that increases towards the bottom surface 13 of dial 11. Indeed, the opposite situation does not provide good anchoring efficiency.

Step b) consists in placing mask 4 on dial 11 but by ensuring that cavities 6 and the openings in mask 2 communicate with each other in order to form a mould.

In step c), said mould is filled so as to form said decorations 5 but also anchoring means 7. This anchoring means 7 includes a part 8 formed in cavity 6. This part 8 is formed of the material deposited in step c) and therefore forms a single part with the decoration 5 associated therewith. The shapes of walls 6*a* of cavities 6 thus improve the anchoring of decorations 5.

Steps d) and e) of this second embodiment are identical in every way to steps d) and e) of the first embodiment. Thus a dial 11 is obtained with a top surface 12 including decorations 5 provided with part 8.

Figure 3A:
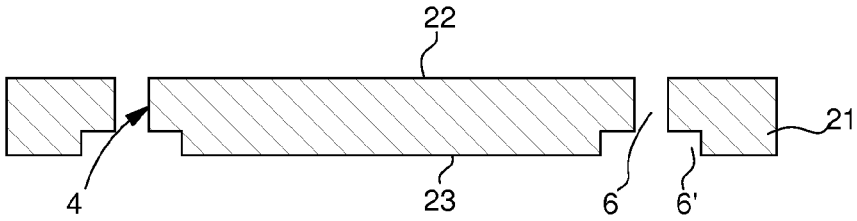
FIGS. 3*a* to 3*e* show schematically the various steps of the method according to a third embodiment of the present invention.
Figure 3B:
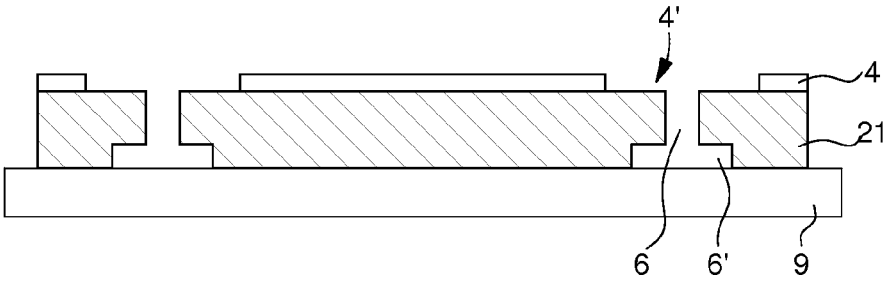
Figure 3C:
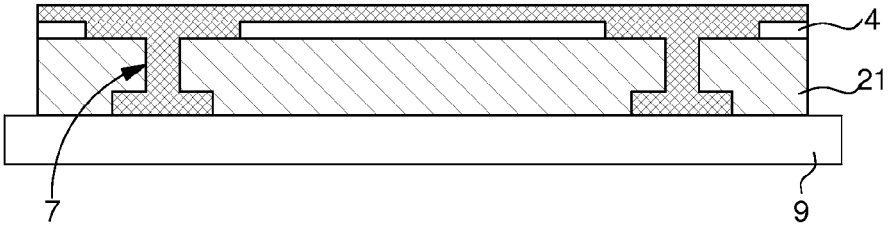
Figure 3D:
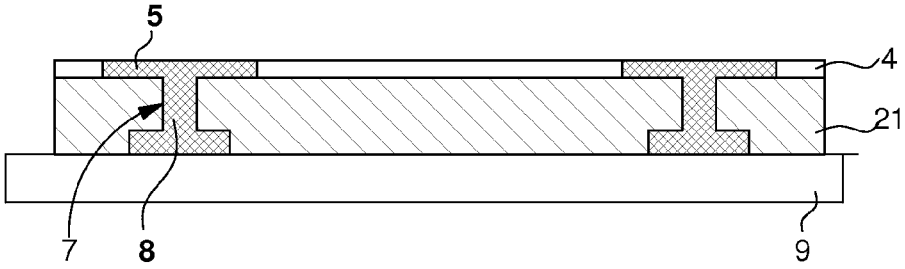
Figure 3E:
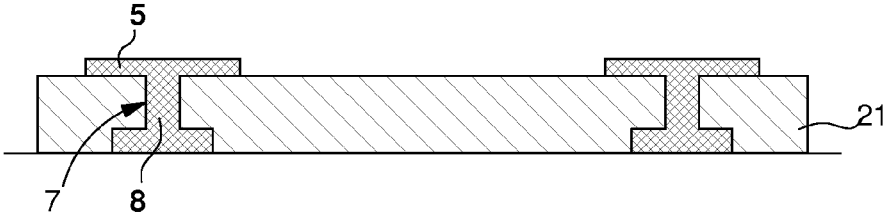

In a third embodiment shown in FIGS. 3*a* to 3*e*, step a) consists in making the dial 21 which is to be decorated. However, this embodiment differs in that there are cavities 6 on the top surface 22 of dial 21 and holes 6' on the bottom part 23 of dial 21. These cavities 6 and holes 6' communicate with each other to form an opening.

Preferably, the section of holes 6' will be larger than the section of cavities 6. Likewise, the depth of cavities 6 will preferably be larger than that of holes 6'. The section of the space formed by cavity 6 and hole 6' may also vary in a uniform manner or hole 6' may be arranged to form a step relative to the section of cavity 6.

Step b) consists, as in the second embodiment, in placing mask 4 on dial 21 ensuring that the openings 4' in mask 24 communicate with the cavities 6 and incidentally with holes 6' so as to form a mould. This step b) also consists in placing dial 21 on means 9 for closing one end of said mould substantially at the level of bottom surface 23.

Step c) consists in filling each mould, i.e. opening 4', cavity 6 and hole 6'. Thus, the anchoring means 7 of the third embodiment includes part 8' formed by cavity 6 and hole 6'. This embodiment is more efficient than the preceding one because the shoulder present between cavity 6 and hole 6' improves the anchoring of decorations 5.

Step d) of this third embodiment is the same as that of the preceding embodiments. Step e) consists in removing mask 4 but also closing means 9. A dial 21 is thus obtained with a top surface 22 including decorations 5 provided with part 8'.

Figure 4A:
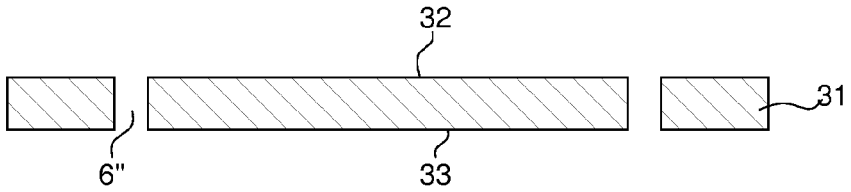
FIGS. 4*a* to 4*e* show schematically the various steps of the method according to a first alternative of a fourth embodiment of the present invention.
Figure 4B:
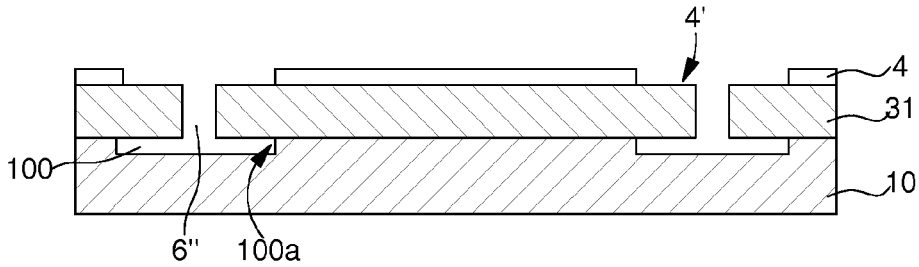
Figure 4C:
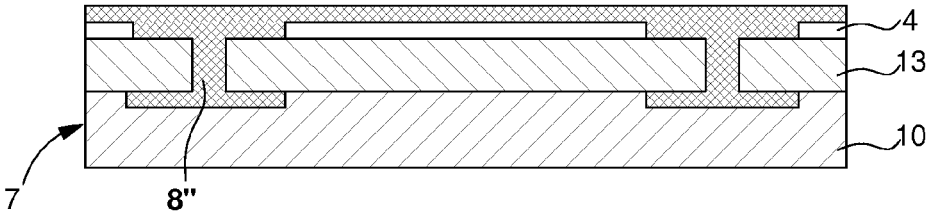
Figure 4D:
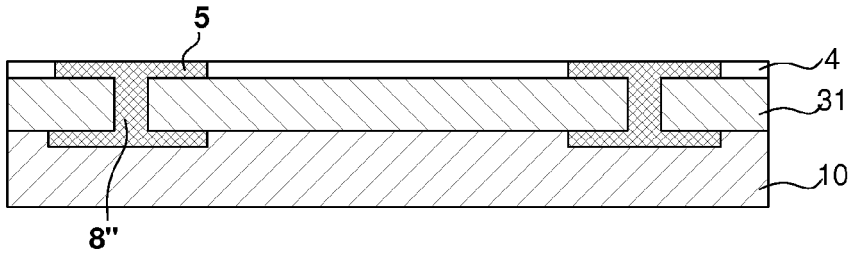
Figure 4E:
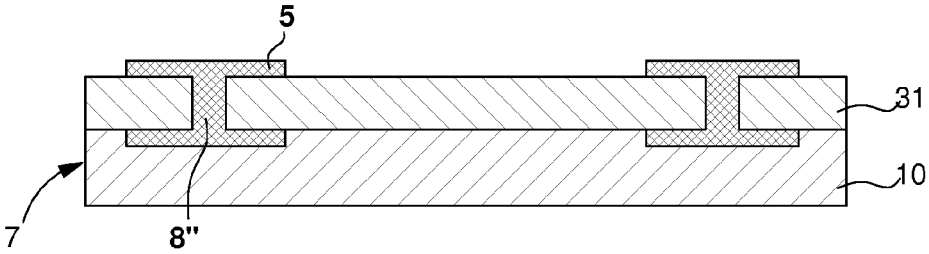

In a fourth embodiment shown in FIGS. 4*a* to 4*e*, step a) consists in making a dial 31 provided with through cavities 6".

Step b) is the same as in the third embodiment, i.e. it consists in placing mask 4 on closing means 10 so as to form the mould?. This means 10 includes hollows 100 which communicate with cavities 6" when dial 31 is placed on means 10. These hollows 100 may have any shape, i.e. may have straight or inclined sides 100*a*. Advantageously, the section of hollows 100 will be greater than that of cavities 6". Each mould for a decoration 5 thus consists of the space created by an opening 4' in mask 4, a cavity 6" and a hollow 100.

Step c) consists in filling the mould with the material forming decorations 5. Thus, as previously, openings 4', mask 4, cavities 6" are filled, as well as hollows 100. This configuration secures decorations 5 in a similar manner to that of the third embodiment but without the drawback of having to pierce dial 31 with two different sections and through two different sides.

In this embodiment, it is thus clear that the anchoring means 7 includes part 8" and closing means 10.

However, in the alternative where support 10 is used only for carrying dial 31 during step c), anchoring means 7 also includes this support 10.

Optional step d) is the same as for all the preceding embodiments.

Step e) is the same as in the third embodiment, i.e. it consists in removing mask 4 and closing means 10. A dial 31 is thus obtained with a top surface 32 including decorations 5 provided with part 8", one portion of part 8" projecting from the bottom surface 33 of dial 31. It is clear that the projecting part can then be used as the feet for dial 31.

However, an alternative to step e) also consists in not separating support 10 from dial 31. A dial 31 is thus obtained with a top surface 32 having decorations 5 provided with part 8" and closing means 10.

It will be clear that various modifications and/or improvements and/or combinations evident to those skilled in the art may be made to the various embodiments of the invention set out above without departing from the scope of the invention defined by the annexed claims. Cavities 6, 6" or holes 6' may be provided with additional anchoring means 7, for example in the form of bumps. These bumps are placed on walls 6*a* or on the bottom of cavities 6. The bumps are filled with the same material and at the same time as decorations 5 so as to offer more efficient anchorage.

Moreover, it will of course be clear that the filling operation performed in step c) is not limited to the methods cited and that any other material filling method may be used.

The invention claimed is:

1. A method of decorating an element, comprising the following steps:

step a): taking the element, said element including anchoring means for improving a securing of decorations to said element; said anchoring means including at least one part mounted in at least one through cavity in said element located at a place to be decorated, said at least one through cavity is smaller on a top face of said element than on a bottom face thereof;

step b): making a mask of a desired thickness of the decorations, and having at least one opening;

step c): placing said at least one opening of the mask against the place to be decorated so as to form at least one mould;

step d): filling said at least one mould with a filling material via galvanoplasty; and step e): removing the mask.

2. The method according to claim 1, wherein a section of said at least one through cavity is smaller than a section of said at least one opening in the mask.

3. The method according to claim 1, wherein said element is placed on closing means so that at least one hollow in the closing means communicates with said at least one through cavity in the element.

4. The method according to claim 1, wherein said method further comprises step f) between steps d) and e), step f) comprising: removing a surplus filling material of the filling material so as to align top surfaces of the decorations with a top surface of said mask.

5. The method according to claim 1, wherein different surfaces of the decorations do not have the same surface state.

6. The method according to claim 1, wherein the element is a timepiece dial.

7. The method according to claim 1, wherein the element is a timepiece bezel.

* * * * *